US006929467B2

(12) United States Patent
Blaschke et al.

(10) Patent No.: US 6,929,467 B2
(45) Date of Patent: Aug. 16, 2005

(54) COMBUSTION CHAMBER ASSEMBLY FOR A HEATING DEVICE

(75) Inventors: Walter Blaschke, Esslingen (DE); Andreas Collmer, Ostfildern (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 158 days.

(21) Appl. No.: 10/324,309

(22) Filed: Dec. 19, 2002

(65) Prior Publication Data

US 2003/0118964 A1 Jun. 26, 2003

(30) Foreign Application Priority Data

Dec. 11, 2001 (DE) ..... 101 60 655

(51) Int. Cl.[7] ..... F23Q 3/00; F23D 11/44

(52) U.S. Cl. ..... 431/261; 431/263; 431/326; 431/350; 431/335; 126/116 R

(58) Field of Search ..... 431/261, 262, 431/326, 263, 353, 329, 328, 350, 335; 126/110 B, 95, 110 C, 96, 110 D, 116 R; 237/12.3 C, 12.3 R, 12.3 B

(56) References Cited

U.S. PATENT DOCUMENTS 4,623,310 A * 11/1986 Kimijima et al. ..... 431/261
5,605,453 A * 2/1997 Kenner et al. ..... 431/262
5,617,995 A 4/1997 Yasuda et al.
5,707,227 A * 1/1998 Langen et al. ..... 431/261
5,993,197 A * 11/1999 Alber et al. ..... 431/261
6,027,334 A 2/2000 Blaschke
6,427,924 B2 8/2002 Takagi et al.
2001/0035463 A1 11/2001 Takagi et al.

FOREIGN PATENT DOCUMENTS

DE 101 20 027 A1 4/2002 ..... B60H/1/22
SE 1 391 154 4/1975 ..... F23D/3/00

* cited by examiner

*Primary Examiner*—James C. Yeung

(57) ABSTRACT

A combustion chamber assembly for a heating device includes a combustion chamber housing which forms a combustion chamber, and an ignition member which projects with an ignition section into the combustion chamber. An evaporator medium, surrounding the combustion chamber radially outward at least regionally, is provided on an outer circumferential wall, bounding the combustion chamber radially outward, of the combustion chamber housing, into which evaporator medium fuel to be evaporated is introduced through the outer circumferential wall.

8 Claims, 3 Drawing Sheets

COMBUSTION CHAMBER ASSEMBLY FOR A HEATING DEVICE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a combustion chamber assembly for a heating device, including a combustion chamber housing which forms a for example substantially annular combustion space, and also an ignition member which projects with an ignition section into the annular combustion chamber.

TECHNICAL FIELD

From DE 195 29 994 A1 there is known an evaporative burner in which an annular combustion space is formed by two connected-together housing portions. Combustion air is supplied by means of an annular inner circumferential wall which is situated radially inward. An outer circumferential wall which bounds the combustion space radially outward is covered with a cylinder-shaped porous lining by means of which the fuel is introduced into the combustion space. At a circumferential region, the outer circumferential wall forms a pocket which is situated radially outside the porous lining and in which the ignition section of a glow ignition pin which serves as ignition member is arranged.

WO 98/49494 discloses an evaporative burner in which a glow ignition pin which serves as ignition member engages with its ignition section, which can be heated by passing current through it, substantially tangentially into an annular combustion space. The ignition pin is arranged in the immediate neighborhood of a floor region of the combustion chamber housing. A porous material which substantially completely covers the floor region is likewise arranged in this floor region. Fuel is introduced into this porous material through the floor region, in order then to evaporate for the production of an ignitable mixture. The porous material covering the floor region has a recess which forms a pocket serving to receive the ignition section of the glow ignition pin.

In the above-described evaporative burners, the positioning of the ignition sections of the various ignition members makes sure that these elements, after ignition and when normal combustion takes place, are situated substantially in a region in which the temperature is markedly below the combustion temperature.

Impairment of the functioning of the ignition members produced by excessive heating could be avoided in this manner. However, a disadvantage of this arrangement is that the radiant energy emitted by the ignition members, admittedly sufficient to support the ignition process, is substantially not usable for supporting the acceleration of the combustion when bringing the burner up to the rated power, because of the positioning, partially screened, of the ignition sections of the various ignition members in respective seating pockets.

SUMMARY OF THE INVENTION

The present invention has as its object to provide a combustion chamber assembly for a heating device, in which the starting phase at the beginning of combustion is shortened.

This object is attained according to the invention by a combustion chamber assembly for a heating device, comprising a combustion chamber housing which forms a combustion space, and also an ignition member which projects with an ignition section into the combustion chamber.

It is further provided according to the invention that an evaporator medium, through which fuel to be evaporated can be introduced through the outer circumferential wall, and which surrounds the combustion chamber radially outward in at least some areas, is provided on an outer circumferential wall, which bounds the combustion chamber radially outward, of the combustion chamber housing.

By the positioning of the ignition member according to the invention and above all, of its ignition section, care is taken that screening by any pockets or other screening members does not occur. On the contrary, the ignition section of the ignition member is situated substantially free in the combustion space. The radiant heat given off by the ignition section thus not only can be used for the ignition process, but also is available for the accelerated bringing up to rated power. Likewise it is ensured by the evaporator medium provided on the outer circumferential region that fuel is vaporized into the combustion space in a sufficient and well-distributed manner.

The evaporator medium is preferably provided at least in that length region of the outer circumferential wall which surrounds the ignition section of the ignition member.

For distribution as evenly as possible of the fuel given off by evaporation into the combustion space, it is proposed that the evaporator medium is constituted as a sheath. It is thus ensured that the evaporation of the fuel can take place, distributed over the whole circumferential area.

The evaporator medium can be constituted of, for example, nonwoven material, felt material, netting, foam ceramic, or the like materials, which make it possible by their porosity for the fuel to be taken up and to be given off to the combustion chamber by evaporation.

In order to make sure that the fuel, on being introduced into the evaporator medium and still liquid, is distributed as rapidly and uniformly as possible within the evaporator medium, it is proposed that the fuel is introduced into a region of the evaporator medium which is situated over the ignition section of the ignition member. By this relative positioning, the fuel is distributed rapidly and uniformly in the evaporator medium, in a manner which is also supported by gravity.

However, in order to avoid, at the beginning of combustion and in the immediate region of the fuel inlet into the evaporator medium, that the fuel not only leaves the evaporator medium toward the combustion chamber by evaporation, but also drips out, it is proposed that a deflecting element is provided for the evaporator medium in that region in which the fuel is introduced into it.

In order to obtain a sufficient mixing with air of the fuel which has reached the combustion chamber by evaporation when performing the ignition process, it is proposed that an ignition air inlet opening arrangement be provided on the combustion chamber housing in a region bearing the ignition member.

Preferably it is further provided that the ignition member extends substantially tangentially into the combustion chamber and/or that combustion air enters the combustion chamber in an approximately tangential direction through the ignition air inlet opening arrangement. Above all, the approximately tangential introduction of the ignition air into the combustion chamber supports the rapid spreading of a propagating flame during the ignition process.

In order to be able to introduce sufficient air into the combustion chamber for performing a combustion which is as low as possible in pollutants, it is proposed that the combustion chamber housing has an inner circumferential wall bounding the internal space radially inward, with a combustion air inlet opening arrangement.

The present invention furthermore relates to a heating device for a vehicle, which heating device has a combustion chamber assembly according to the invention.

It should be mentioned here that when speaking of "ignition air" or "combustion air" in connection with the present invention, these are to include any gas which can produce a combustible mixture in combination with the fuel being used. The mentioned air thus forms only a non-limiting example of a usable gas.

BRIEF DESCRIPTION OF THE DRAWINGS

The present invention is described in detail hereinafter with reference to the accompanying drawings.

DETAILED DESCRIPTION OF THE INVENTION

Figure 1:
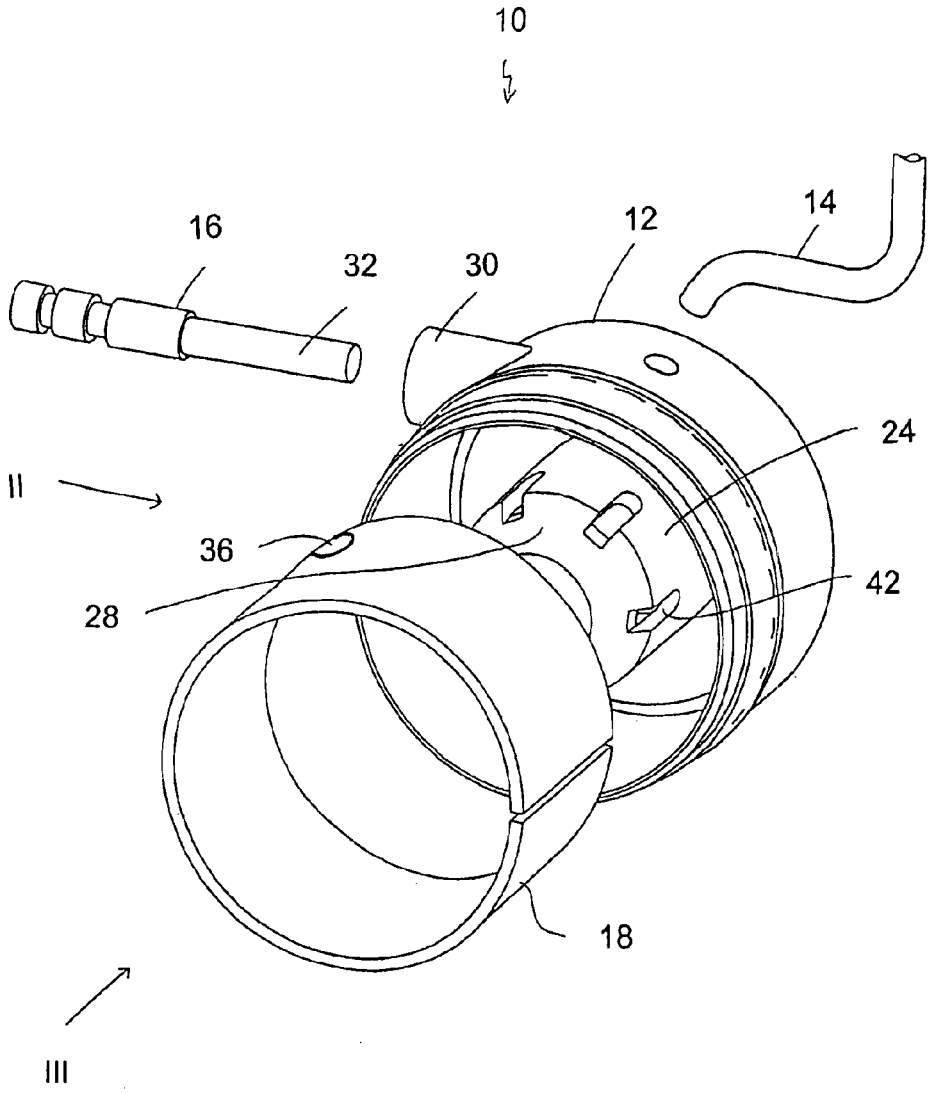
FIG. 1 shows a perspective exploded diagram of a combustion chamber assembly according to the invention.
Figure 2:
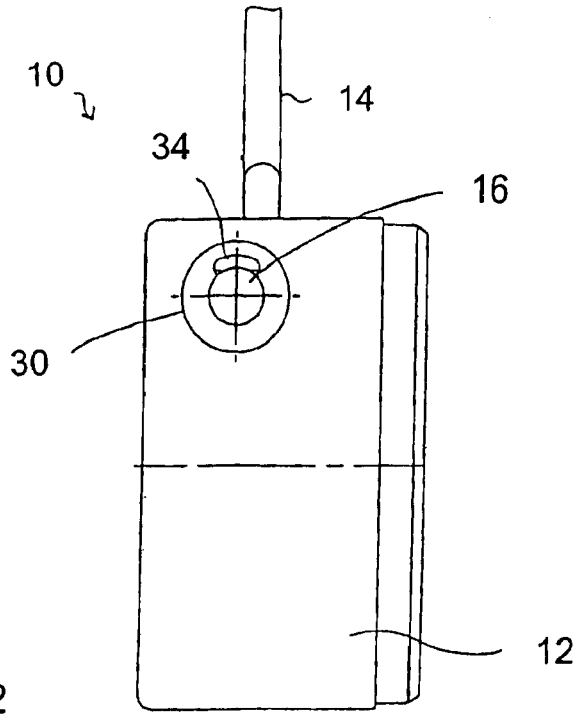
FIG. 2 shows a side view of the combustion chamber assembly seen in the direction II in FIG. 1.
Figure 4:
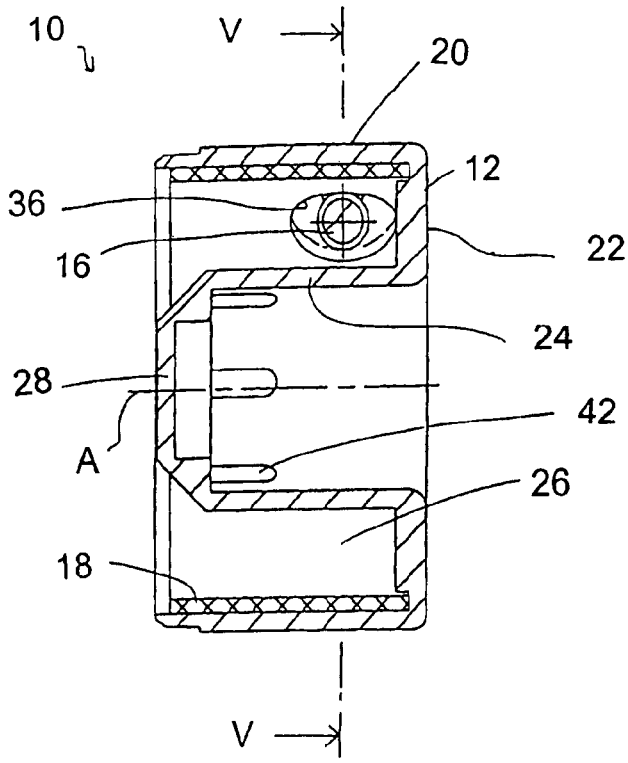
FIG. 4 shows a longitudinal sectional diagram of the combustion chamber assembly according to the invention, sectioned in the plane IV—IV in FIG. 5.

FIG. 1 shows a combustion chamber assembly 10 according to the invention, in an exploded view. The essential components of the combustion chamber assembly 10 can be seen here. These are a combustion chamber housing 12, shaped for example out of metal sheet material, a fuel supply duct 14, a glow ignition pin 16, and also an evaporator medium 18 constituted in sheath form and constructed of, for example, nonwoven material or other porous material. It can also be seen in FIG. 4 that the combustion chamber housing 12 is of pot-like constitution and has an outer circumferential wall 20 and also a floor region 22. A raised portion is provided in the central region of the floor region 22, and forms an approximately cylindrical inner circumferential wall 24 which is substantially concentric of the outer circumferential wall 20. This inner circumferential wall 24 merges into an end wall 28. Thus a substantially annular combustion chamber 26 is formed between the inner circumferential wall 24 and the outer circumferential wall 20. The evaporator medium 18, which is of sheath-like constitution and is open at a circumferential region for adaptation to the outer circumferential wall 20, is provided on the inner side of the outer circumferential wall 20 in the assembled state of the combustion chamber assembly 10, or abuts on the outer circumferential wall 20, and extends substantially over the whole length of the outer circumferential wall 20. This means that the combustion chamber 26 in the region of the combustion chamber housing 12 is radially outwardly surrounded by, or also bounded by, the evaporator medium 18 over the whole length.

Figure 3:
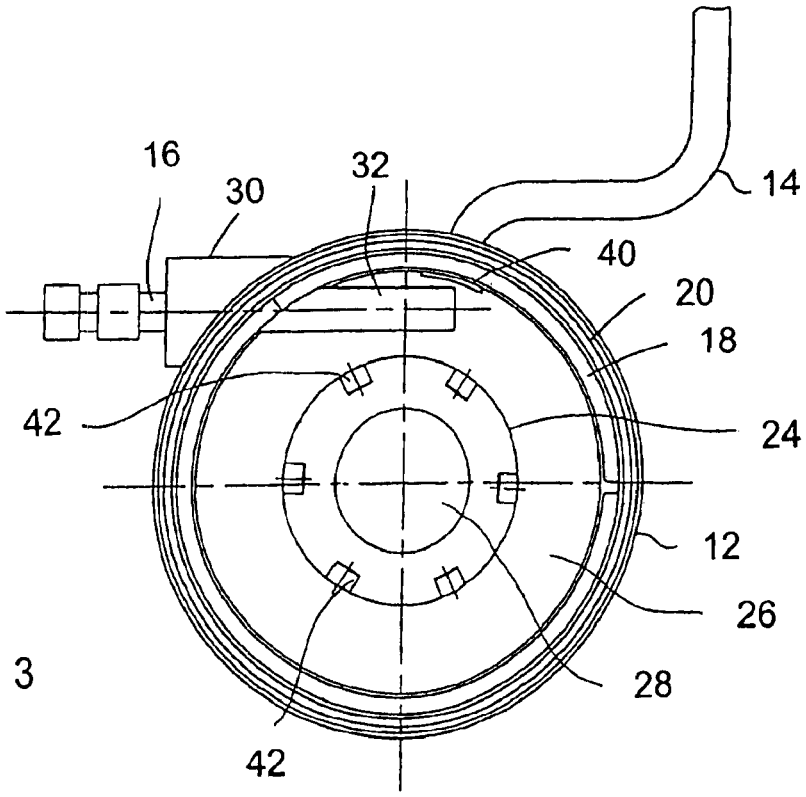
FIG. 3 shows a front view of the combustion chamber assembly according to the invention, seen in the direction III in FIG. 1.
Figure 5:
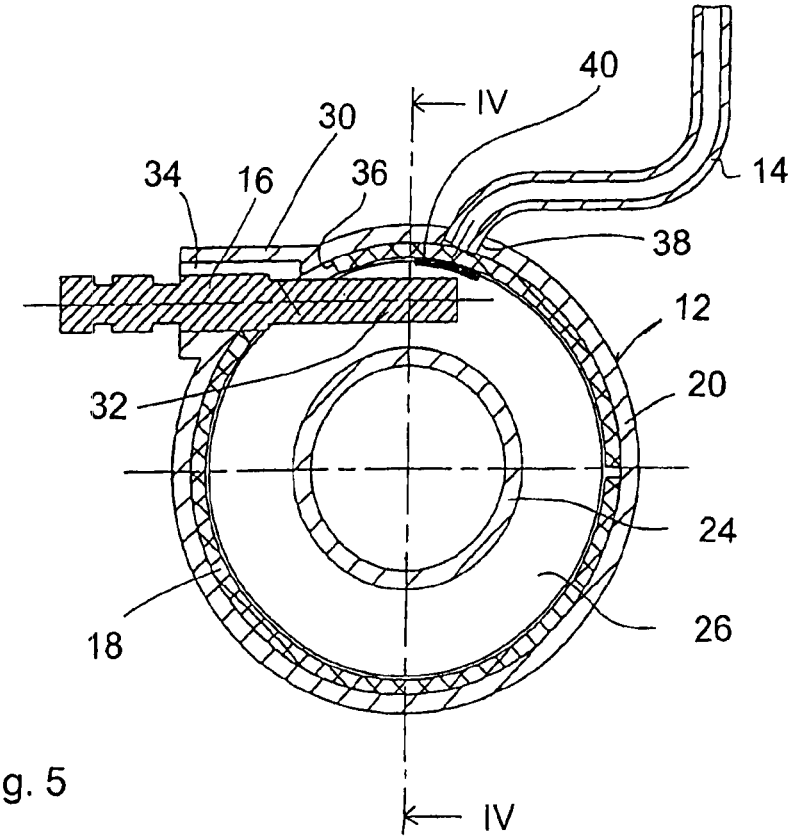
FIG. 5 shows a cross sectional diagram of the combustion chamber assembly according to the invention, sectioned in the plane V—V in FIG. 4.

An insertion stub 30 for the glow ignition pin 16 is provided in a circumferential region on the combustion chamber housing 12 or on the outer circumferential wall 20 of the same. It can be seen in FIGS. 3 and 5 that after the insertion of the glow ignition pin 16 into the insertion stub 30, the ignition section 32 of the glow ignition pin 16, which can be heated by passing a current through it, projects approximately at a tangent or secant—relative to the annular contour of the combustion chamber 26 around the housing longitudinal axis A—into the combustion chamber 26. The insertion stub 30 furthermore forms a channel or an opening 34 by means of which the air required for ignition is introduced, if necessary also forwarded by a fan, and in fact into that region which also contains the ignition section 32 of the glow ignition pin 16. Care is thus taken that the air provided for ignition is present in the region in which it is also required. It can furthermore be seen in FIG. 5 that in that region into which the glow ignition pin 16 is introduced into the combustion chamber 26 through the stub 30, the evaporator medium 18 has an opening 36 through which the glow ignition pin 16 then passes and through which the ignition air can flow into the combustion chamber 26.

The fuel supply duct 14 is introduced into an opening 38 provided in the outer circumferential wall 20 and conducts the fuel directly to the outside of the evaporator medium 18. A deflecting element 40 is provided on the side of the evaporator medium 18 facing toward the combustion chamber 26 in that region into which fuel is introduced into the evaporator medium 18 through the fuel supply duct 14. This deflecting element 40 makes sure that a lateral distribution occurs also at the place where the fuel is introduced, and thus there is no danger that the fuel does not evaporate, but drips off, due to an excessive accumulation of fuel at the inner upper side of the evaporator medium. It can furthermore be seen that the region in which the fuel is introduced into the evaporator medium 18 is, on the one hand, provided in the upper region of the evaporator medium 18, and on the other hand is positioned very close to, and over, the ignition section 32 of the glow ignition pin 16. This position allocation is above all also present in the built-in state of a heating device containing the combustion chamber assembly 10. Care is thus taken that on ignition in the region of the ignition section 32, a comparatively high concentration of evaporated fuel is provided. The positioning in the upper region makes sure that the distribution of the fuel in the evaporator medium can also be supported by gravity.

After ignition and during the transition to normal combustion, the required air can then be introduced through numerous openings 42 which are provided in the inner circumferential wall 24 near the end wall 28.

The design of the according to the invention has numerous advantages in operation. Thus the positioning of the glow ignition pin 16 such that it projects approximately an angle of 90° relative to a vertical line and tangentially into the combustion chamber 26 has the advantage that the ignition air flowing into the combustion chamber 2 in approximately the same direction through the opening 34 makes sure of a very rapid distribution of the ignition flame over the whole circumferential region of the combustion chamber 26. Moreover, the ignition section 32 of the glow ignition pin 16 in the combustion chamber 26 is not covered by any screening materials, and thus lies free in the combustion chamber 26. The radiant heat produced in the region of the ignition section 32 can thus be used, not only for the ignition process, and thus in the immediate neighborhood of the ignition section 32, but also supports propagation of the combustion when running up to rated power. The starting phase of a heating device equipped with a combustion chamber assembly according to the invention can thus be markedly shortened. Particularly when the glow ignition pin 16 is constituted with a PTC characteristic (positive thermal coefficient), i.e., that the electrical resistance of the same rises with increasing heating, this can also simultaneously be used as a flame monitor in that region in which the combustion will also take place. The omission of screening material, e.g. a so-called plug sieve, surrounding the ignition section 32 of the glow ignition pin 16 further simplifies construction and leads to a marked cost reduction of such an assembly, and likewise to a very simple structure which can otherwise be recognized. Also maintenance work can be very easily performed, e.g., replacement of the glow ignition pin 16. This has only to be pulled out and can be replaced by a new glow ignition pin in a simple manner. It should be remarked here that ceramic glow pins, which have a temperature of up to 1.450°[C.], are preferably used as the glow ignition pin.

What is claimed is:

1. A combustion chamber assembly for a heating device, including a combustion chamber housing (12) which forms a combustion chamber (26), and an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), and a deflecting element (40) provided at the evaporator medium (18) in that region in which a fuel is introduced into the combustion chamber.

2. A combustion chamber assembly for a heating device, including a combustion chamber housing (12) which forms a combustion chamber (26), and an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), and an ignition air inlet opening arrangement (34) provided on the combustion chamber housing (12) in a region carrying the ignition member (16).

3. A combustion chamber assembly for a heating device, including a combustion chamber housing (12) which forms a combustion chamber (26), and an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), and an air inlet opening arrangement (34) wherein ignition air enters the combustion chamber (26) in an approximately tangential direction through the air inlet opening arrangement (34).

4. A combustion chamber assembly for a heating device, including combustion chamber housing (12) which forms a combustion chamber (26), and an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), wherein the ignition member (16) extends substantially tangentially into the combustion chamber (26).

5. A combustion chamber assembly for a heating device, including a combustion chamber housing (12) which forms a combustion chamber (26), an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), and a deflecting element 40 provided at the evaporator medium (18) in that region in which a fuel is introduced into the combustion chamber.

6. A combustion chamber assembly for a healing device, including a combustion chamber housing (12) which forms a combustion chamber (26), an ignition member (16), which projects with an ignition section (32) into the combustion chamber (26), the combustion chamber having an outer circumferential wall (20), an evaporator medium (18), surrounding the combustion chamber (26) radially outward at least regionally provided on the outer circumferential wall (20), bounding the combustion chamber radially outward, of the combustion chamber housing (12), into which evaporator medium (18) fuel to be evaporated is introduced through the outer circumferential wall (20), and ignition air inlet opening arrangement (34) provided on the combustion chamber housing (12) in a region carrying the ignition member (16).

7. The combustion chamber assembly according to claim 6, wherein ignition air enters the combustion chamber (26) in an approximately tangential direction through inlet opening arrangement (34).

8. The combustion chamber assembly according to claim 6, wherein the ignition member (16) extends substantially tangentially into the combustion chamber (26).

* * * * *